United States Patent [19]

Scheffel

[11] 4,183,382

[45] Jan. 15, 1980

[54] APPARATUS FOR WEFT INSERTION IN A WEAVING LOOM

[76] Inventor: Walter Scheffel, Hopfenstrasse 14, D 8832 Weissenburg, Fed. Rep. of Germany

[21] Appl. No.: 772,834

[22] Filed: Feb. 28, 1977

[30] Foreign Application Priority Data

| | | | |
|---|---|---|---|
| Feb. 27, 1976 | [DE] | Fed. Rep. of Germany | 2608030 |
| May 19, 1976 | [DE] | Fed. Rep. of Germany | 2622148 |
| Jun. 18, 1976 | [DE] | Fed. Rep. of Germany | 2627391 |
| Sep. 4, 1976 | [DE] | Fed. Rep. of Germany | 2639998 |

[51] Int. Cl.[2] ..... D03D 47/30

[52] U.S. Cl. ..... 139/435

[58] Field of Search ..... 139/188, 192, 435

[56] References Cited

U.S. PATENT DOCUMENTS

| | | | |
|---|---|---|---|
| 2,714,403 | 8/1955 | Turner | 139/188 |
| 2,796,085 | 6/1957 | Svaty et al. | 139/435 |
| 3,139,118 | 6/1964 | Svaty et al. | 139/435 |
| 3,818,952 | 6/1974 | Vermuelen et al. | 139/435 |
| 3,821,972 | 7/1974 | Svaty et al. | 139/435 |
| 3,847,187 | 11/1974 | Buran et al. | 139/435 |
| 3,977,443 | 8/1976 | Zahradnik et al. | 139/435 |
| 4,031,926 | 6/1977 | Zollinger et al. | 139/435 |

*Primary Examiner*—Henry Jaudon

*Attorney, Agent, or Firm*—Becker & Becker, Inc.

[57] ABSTRACT

An apparatus for picking a weft through the shed of a loom in which separator elements interposed between the warp threads are provided with a recess defining a passageway along which the weft thread is conveyed during the picking operation. The picking is accomplished by fluid jets, preferably in the form of compressed air, which are directed angularly toward the passageway in the picking direction.

23 Claims, 12 Drawing Figures

Figure 1:
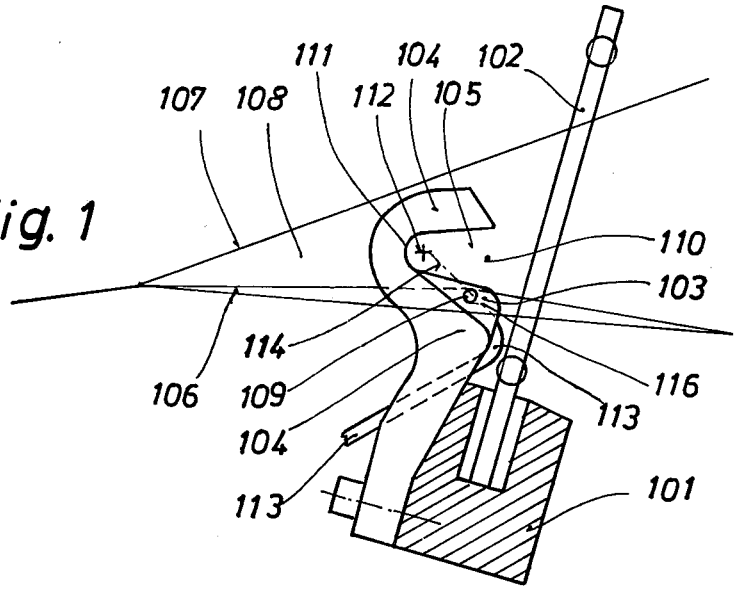

IV
IV
V
V
202
203
204
205
206
207
208
209
210
211
212
213
214
216
218
219
220
201

APPARATUS FOR WEFT INSERTION IN A WEAVING LOOM

In weaving looms of recent design, the weft (filling) yarn is inserted in a shed by means of a fluid, for instance, compressed air. Weft insertion by means of such a fluid enables picking to be effected at a very high speed and in many cases without the risk of the weft yarn catching on the warp yarn which passes perpendicularly to the weft through the shed or on the shed formed by individual lamination elements or weft-inserting channel-forming teeth.

There has been known an apparatus (German Offenlegungsschrift 1,941,550, German Offenlegungsschrift 2,323,650) for weft insertion in a shed having a U-shaped weft passage formed in the reed and nozzles provided in pipe-shaped nozzle mounts which admit a conveying fluid from a long distance at a moderately acute angle. As a result, this type of apparatus is highly wasteful of energy and uneconomical because it is necessary to adopt high air pressures and long jet lengths. Also in the case of looms of this type it is necessary for the nozzles which extend freely like a needle into the shed and their mounts to be arranged at a distance and with a jet orientation relative to the weft passage so that they are not located in the zone of a flow cone of the preceding nozzle because the effect of jet deflection would destroy the flow and interfere with the weft conveying action resulting in snarling and weft faults. The drawback of this design is not only in the heavy reed which can only be made by hand working and consequently at high cost, but also in the fact that the inertia forces and low flexibility of such wide reed confusors which will not avoid the knots of the warp, restrict the performance of this type of loom. Any change in the quality of the cloth made by varying the density of the fabric in the warp calls for another expensive special reed.

Furthermore, the nozzles formed freely as pointed needles extending into the shed suffer from a disadvantage in that the nozzle hole cannot be made with a length for a favorable jet pattern and therefore result in an uncontrolled jet cone with little conveying action being applied to the weft.

An attempt has been made to overcome this additional drawback by another apparatus (German Offenlegungsschrift 2,522,335) in which a number of guiding surfaces are proposed to be inserted in the nozzle hole of insufficient length, similar to a filter, whereby the nozzle hole, which as such is too small, is divided into a plurality of microholes so that as a result of the increased friction resistance, efficiency is again diminished and energy requirements are further increased, while there is the added risk of dirt depositing in such microholes. Thus the advantages sought are obtained at the expense of new drawbacks so that there is no improvement at all.

There are known a number of apparatuses (German Offenlegungsschrift 2,010,905 and German Offenlegungsschrift 2,145,256) where a weft guiding passage formed by lamination elements of weft-inserting channel-forming teeth performs this function independent of the design of the reed for the guidance and conveyance of the weft and the nozzle provided for this purpose and spaced across the cloth width direct their jet cone into this passage. Since these nozzles with their round shape and being disposed close to the reed cannot be kept out of the zone of the jet cone of the preceding nozzle, jet deflection plus turbulence causing weaving faults cannot be excluded which is why these systems have not heretofore been accepted in practical operation. Even where the admission of the jet cones is from an area close to the lower shed, it was necessary in order to confine the weft trajectory to provide additional bar lamination elements or weft-inserting channel-forming teeth close to the reed. In both cases, it was necessary for the exit of the weft on traversing the shed to pass an extremely narrow weft outlet slot at the top of the lamination elements or weft-inserting channel-forming teeth system.

There are further designs known (German Offenlegungsschrift 2,236,759 and German Offenlegungsschrift 2,331,364) similar to the aforementioned types where likewise the weft after picking is withdrawn through an extremely narrow outlet slot close to the upper shed so that the shed forming time periods in spite of the different requirements imposed by the various types of fabric are dictated by this weft outlet slot of predetermined location and restrict the scope of application of the looms.

Apart from these drawbacks, these designs likewise include nozzles spaced across the cloth width which are subdivided into a plurality of small nozzle holes of various shapes which according to established laws cannot but have a poor efficiency with high energy requirements which heretofore has precluded the industrial use of such looms.

Accordingly, this invention has for its object, by the use of outlet openings affording favorable flow conditions for the fluid in conjunction with the provision of nozzle lamination element or weft-inserting channel-forming teeth shapes, to reduce the energy requirements of the loom for weft insertion and yet to ensure positive weft insertion while largely avoiding the use of weft outlet slots of the type known to be proposed on lamination elements or weft-inserting channel-forming teeth and liable to cause faults.

This task is solved by means of apparatus for inserting a weft in a shed of a loom by means of a fluid, specifically a gaseous fluid, in which the weft is guided in a weft passage formed by comb-type lamination elements or weft-inserting channel-forming teeth arranged in series and where part of the lamination elements or weft-inserting channel-forming teeth are provided with outlet openings (nozzles) for the discharge of fluid and where the weft passage is formed with a radius at a vertical distance from a reed plane as a boundary of the weft passage towards at least one side and where each fluid discharge opening is arranged in a lamination element or weft-inserting channel-forming teeth means associated with it so that in a direction downstream a jet of fluid has an increasing distance from a reed plane as the distance from this discharge opening (nozzle) increases but, relative to a longitudinal axis of the weft passage has a decreasing distance from this reed plane in a direction downstream and that for the supply of the discharge openings (nozzles) with fluid at least two discharge openings (nozzles) each are connected to a pressurizing means (pump) each and capable of being supplied with fluid by this pressurizing means at discharge openings (nozzles) associated with said pressurizing means in synchronism with the insertion movement of the weft.

In contrast to the measures proposed heretofore to overcome these sources of faults by the use of additional means, such as mechanical control of the confusors or additional nozzles to control flow which made those apparatuses more complex and more vulnerable, a solution is achieved by the apparatus according to the invention as a result of this simplification so that, on traversing the weft passage the weft yarn on its way to the reed does not encounter a constriction but has available what has heretofore been the widest space in conjunction with reduced stressing of the yarn.

All parts at the ends of the teeth, lamination elements or nozzle mounts which heretofore have separated the weft passage from the reed can be omitted according to the object of the invention inasmuch as the step-shaped inner contours achieved by different inclinations of the lower teeth or lamination element arms permit the use of a nozzle shape whose length is easily a multiple of the nozzle hole and, consequently, ensures precise jet cones and, as far as the supply of the fluid is concerned, can be designed for favorable flow and free from losses.

Furthermore, the apparatus according to the present invention makes it possible for the conveying flow directed against the inner radius of the weft passage to be maintained guided across the cloth width in the fashion of a bundle as a result of the duct formed there by thickening (of the lamination elements or teeth) with the conveying fluid being free to flow through the outlet openings (nozzles) spaced across the cloth width through a gap in the shed formation into the passage.

Further advantageous embodiments of the apparatus constructed according to the invention will be found in particular in the remaining sub-claims.

Figure 2:
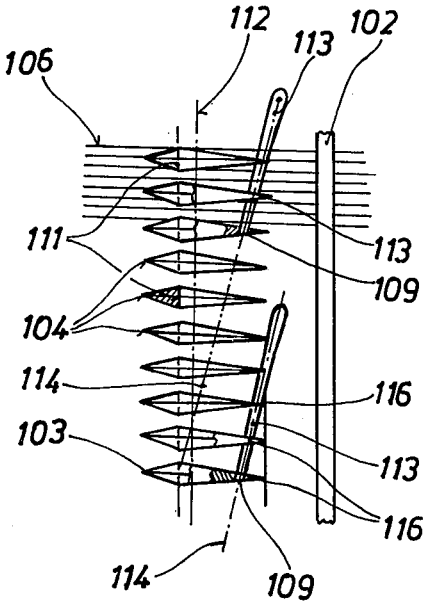
Figure 3:
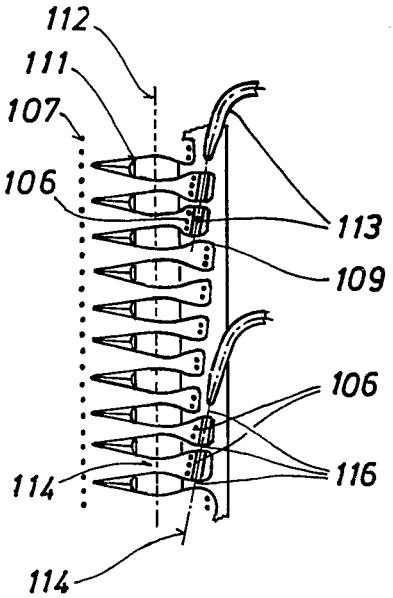
Figures 4, 5, 6:
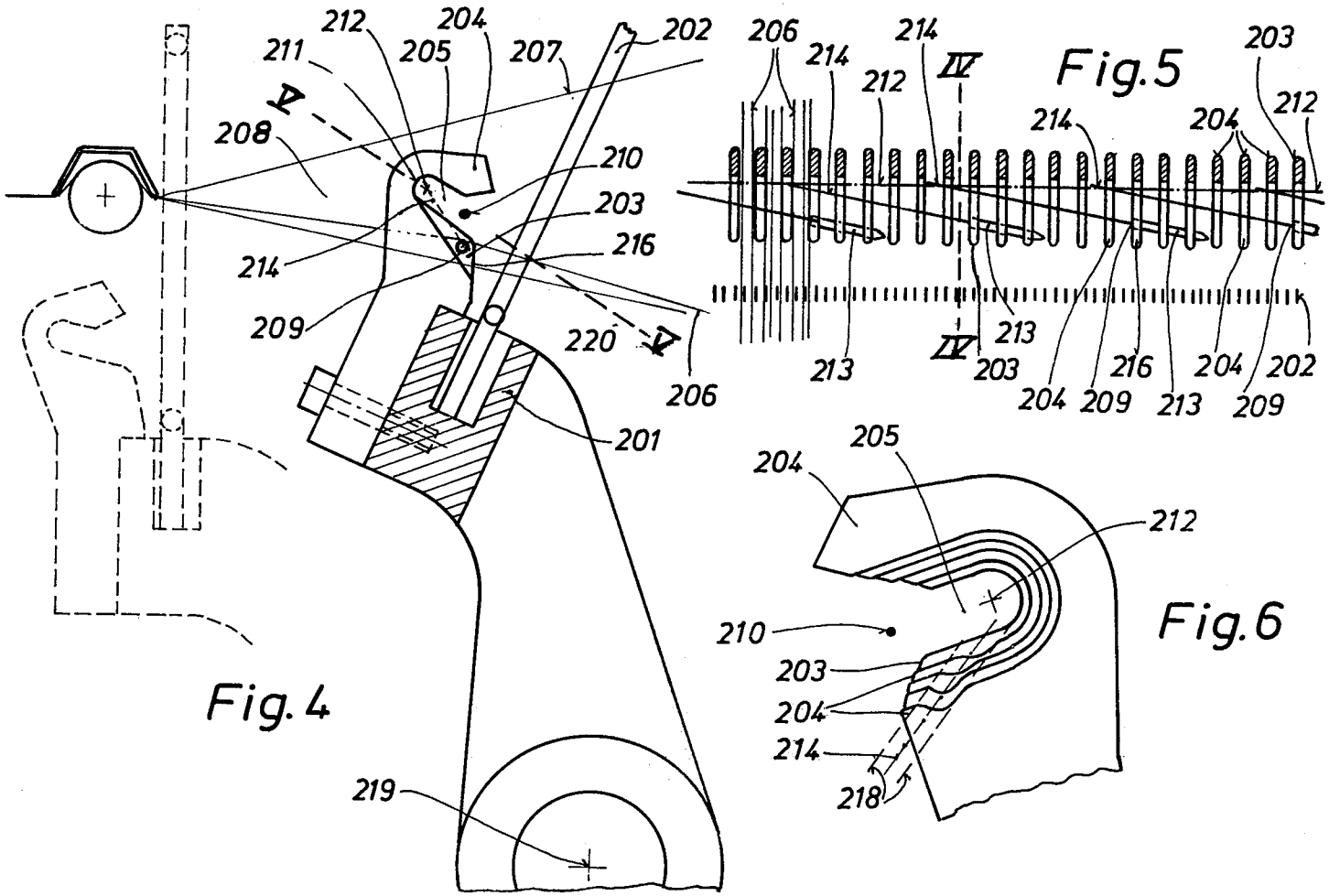
Figure 8:
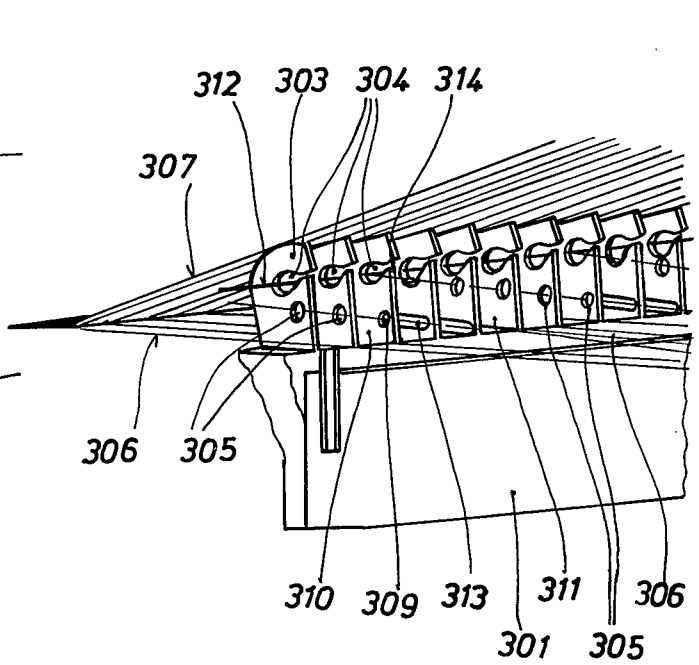
Figure 7:
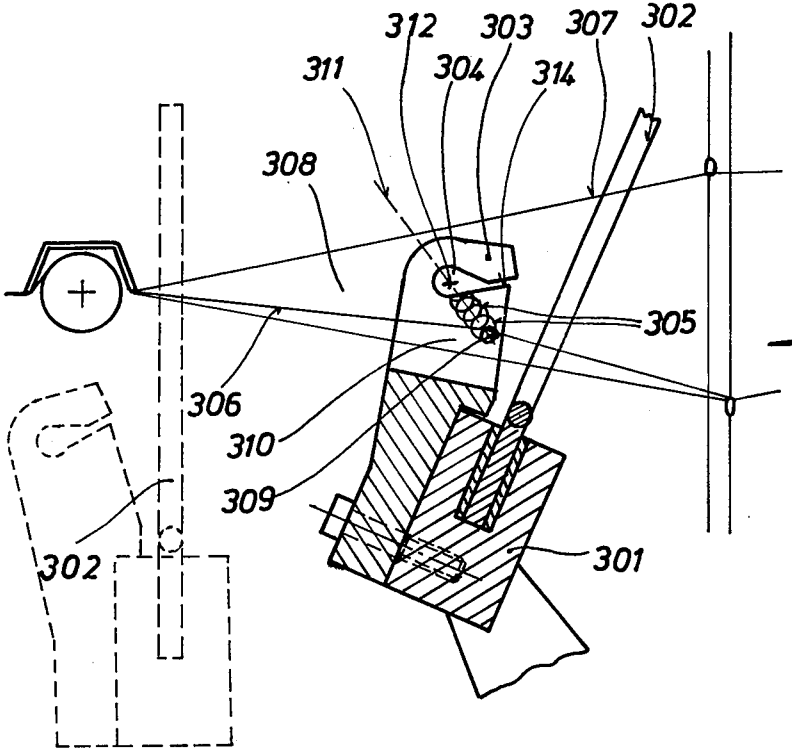
Figures 9, 10, 11, 12:
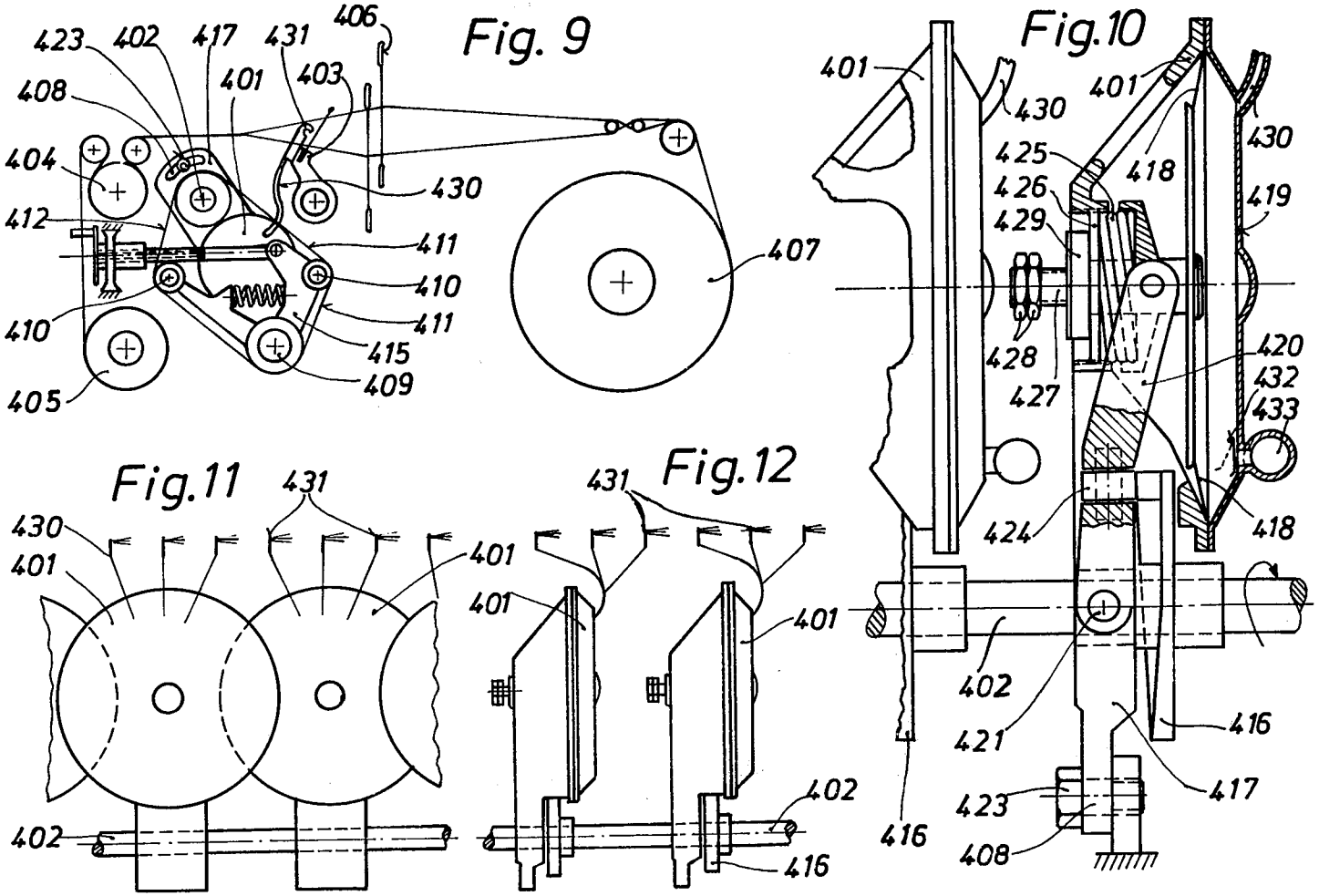

A number of typical embodiments of the invention are schematically shown in the accompanying drawings wherein:

FIG. 1 is a side view of apparatus for inserting a weft in a shed of a weaving loom, FIG. 2 is a plan view of the apparatus shown in FIG. 1, FIG. 3 is a front view of apparatus according to FIG. 1, but without a reed arranged in front of the lamination elements or teeth, FIG. 4 is a side view of the apparatus in the section V—V according to FIG. 5, FIG. 5 is a plan view of the apparatus on section IV—IV according to FIG. 4, FIG. 6 is a perspective view of the confusors looking from the direction of weft insertion, FIG. 7 is a side view of the apparatus with a lamination element or tooth comb extending through the harp of yarn into the shed, FIG. 8 is an isometric view of the apparatus according to FIG. 7 in the weft insertion position, FIG. 9 is a side view of a loom with a plurality of pressurizing means supplying the nozzles, FIG. 10 shows two pressurizing means according to FIG. 9, and FIGS. 11 and 12 are each a schematic plan view of several pressurizing means in various possible superimposing arrangements on the loom.

In the typical embodiment illustrated by FIGS. 1 to 3, a loom slay 101 with reed 102 is moved on an arc of a circle in a manner that the weft passage 105 formed by teeth, lamellar segments, droppers or separator elements 103, 104 moves into and out of the shed 108 formed by the lower warp yarn 106 and upper warp yarn 107. The weft passage 105 formed by teeth or elements 103, 104 is adjacent to the loom slay 101 and comprises passage means or outlet openings in the form of nozzles 109 spaced across the cloth width, said outlet openings being supplied through pipe means 113 with a fluid jet, for example compressed air. The weft passage 105 defined by teeth 103 with outlet openings, i.e. nozzles 109, and teeth 104 without nozzles has its greatest opening or cross sectional area 110 at the reed side so that the weft passage 105 narrows in a perpendicular direction away from the reed plane and terminates with a radius 111 as the envelope surface close to a major axis 112 of the passage for controlled weft guidance. Disposed between the teeth 103 with outlet openings (nozzles) 109 which are shaped with a small angle towards the reed side opening 110 there are teeth 104 which are shaped with a greater angle towards the reed side opening 110 so that the reed side opening 110 increases stepwise after the nozzle 109. The nozzles 109 or outlet openings in the form of nozzles located in the teeth 103 are arranged in the vicinity of the reed side opening 110 in a manner such that the axis 114 of the emitting fluid jet is directed with the distance from the plane of the reed 102 increasing downstream and, in a direction towards the main axis 112 of the passage, the distance decreases downstream so that the axis 114 of the emitting jet will not intersect the hull surface on that side of the passage 105 on which are disposed the nozzles 109 or outlet openings whereby a superimposing bundled conveying flow is obtained in the radius 111 of the passage without turbulence across the full cloth width. This favorable effect to maintain a turbulence-free and loss-free conveying flow is further assisted by the fact that the thickness of the teeth 103 and 104 increases in a perpendicular direction away from the reed plane, i.e., reed 102 to reach its point of maximum thickness or width at the narrowest point of the passage in the radius 111. This point of maximum thickness or width of the teeth 103, 104 is favorably located at the middle between the reed 102 and a fabric end so that this slight spreading of the warps does not cause fabric striping or stressing of the yarn.

The nozzles 109 placed in the teeth 103 here have a supply or feed line 113 whose length is a multiple of the cross-section of the hole of the nozzles 109 so that a favorable and loss-free supply of fluid exists whereby energy consumption is lowered. The arrangement of this supply or feed line 113 through the arms 116 of the teeth which taper towards the reed side opening 110 in accordance with the invention, allows the warp yarn of the lower shed 106 to lie on them and at the same time inside the flow silhouette of the parts of the arm 116 extending above the supply or feed line 113 so that any contact between the weft and the warp yarn is avoided.

In the typical embodiment illustrated by FIGS. 4 to 6, the slay 201 with the reed 202 is also moved on a circle around the axis 219 so that the weft passage 205 formed by lamination elements or teeth 203 and 204 extends into and moves out of the shed 208. The contour of the lamination elements or teeth 203,204 shown by dashed lines shows how the apparatus moves into the position of beating up the weft against the fabric and spreader and, consequently, does not involve any deviation from or disadvantages against a conventional layout.

The weft passage 205 formed by lamination elements or teeth 203 and 204 is attached to the slay 201 and supports the nozzles 209 which are spaced across the cloth width and are supplied through the feeds 213 with fluid, for example also compressed air. The weft passage 205 which also is formed by lamination elements or teeth 203 with outlet openings, i.e., nozzles 209, and lamination elements or teeth 204 without nozzles has a wide opening 210 at the reed side so that the weft passage 205 is proportioned in a manner that its extent in a direction perpendicular away from the reed plane or reed 202 is greater than or equal to its extent in the direction of the reed bars or strips and terminates with a radius 211 close to the major axis 212 of the passage for weft guidance control, i.e., envelope surface or radius 211.

Between the lamination elements or teeth 203 with outlet openings, i.e., nozzles 209 which towards the reed side opening 210 are shaped parallel or with a small angle, there are lamination elements or teeth 204 which towards the reed side opening 210 have a greater angle so that the reed side opening 210 of the passage is increased stepwise after each outlet opening or nozzle 209. These nozzles 209 placed in the lamination elements or teeth 203 are arranged in the vicinity of the reed side opening 210 of the passage in a manner that the axis 214 of the emitting jet of fluid is oriented with its distance from the plane of the reed 202 increasing in a downstream direction and with a decreasing distance relative to the major axis 212 of the passage in the downstream direction so that the axis 214 of the emitting jet does not intersect the envelope surface, i.e., radius 211, on that side of the weft passage 205 where the nozzles 209 or outlet openings are located and the effective range of the nozzles is so matched that each preceding outlet opening or nozzle 209 provides guidance of the weft yarn 212 to a point over the throat of the following nozzle 209 whereby an overlapping of the effective ranges of the individual nozzles 209 is produced. This favorable effect to maintain a straight trajectory of the weft through the weft passage 205 which is not affected by the suction effect of the individual nozzles 209 is further assisted in that the inner envelope surface, radius 211, of the lamination elements or teeth 203,204 forming the weft passage 205 may form substantially a parallel line relative to the axis 214 of the emitting jet in that the envelope surface of the lamination elements or teeth 203,204 are formed with a channel-shaped recess 218 in the region of the emitting jet. According to the invention, the nozzles 209 or outlet openings placed in the lamination elements or teeth 203 have a straight feed 213 whose length is a multiple of the cross section of the hole of the nozzle 209 so that a favorable, loss-free supply of fluid and reduced energy consumption are ensured.

The combination according to the invention of a weft passage 205 formed by lamination elements or teeth 203, 204 where the warp yarn 206 and 207 lie in the flow shadow of the fluid with nozzles 209 shaped with a length 213 which is a multiple of the cross section of the hole of the nozzle and which nozzles discharge into the shed 208 through a shed stage or step 220 and can act without restriction, represents a substantial progress and another improvement of these looms.

In the case of the typical embodiment illustrated by FIGS. 7 and 8, again there is a slay 301 with a reed 302 moving on a circle in a manner that the weft passage formed by teeth 303 extends into and moves out of the shed 308. The dashed lines in FIG. 7 show how the apparatus moves in the position of beating up the weft against the cloth and spreader and, consequently, involves no deviation from or disadvantages against a conventional layout.

The teeth 303 have cutouts 304 of such a shape as to cover each other when placed upon each other, and forming a weft passage. Furthermore, each tooth 303 has a slot-shaped opening 314. The openings also have such a shape as to cover or coincide with each other when placed upon each other for the removal of the weft after picking has been completed. These slot-shaped openings 314 communicate with the cutouts 304 and lead from the latter towards the reed 302. In addition, the teeth 303 have non-coinciding windows 35 which are so arranged that they form a passage for the fluid in a number of successive teeth 303, the axis 311 of said passage being at a distance from the passage 304 formed by the cutouts 304 which decreases in a direction downstream, said fluid passage joining the passage 304. Spaced across the cloth width there are several such passages formed by windows 305 on an axis 311 into which again opens a nozzle 309 each. The nozzles 309 have a straight feed 313 for the conveying fluid and these feeds are arranged so that part of the warp yarns 306 come to rest on these and form a step at a distance from the teeth 303 and, consequently, a gap 310 in the harp of warp yarn 306 through which the flow of conveying fluid can pass freely around the axis 311 to propel the weft 312 in the passage of the cutouts 304. The webs or surfaces of the teeth 303 between the cutouts 304 and the windows 305 act to ensure an undisturbed straight weft trajectory inasmuch as the weft 312 is prevented from following the suction and deflection effects in the vicinity of the nozzle 309. The use of these measures enables the shed 308 formed by upper warp yarn 307 and lower warp yarn 306 to be kept at a minimum whereby at the same time the effective range of the conveying flow provided on the axis 311 can be shortened and directed more efficiently to propelling the weft 312. Even if the height of the shed 308 is extremely reduced, the warp yarn 306 will be maintained in the flow shadow of the two passage systems, i.e., that of the cutouts 304 and that of the windows 305. The direction of the axis 311 shows that the conveying fluid flow keeps the weft 312 towards that side of the passage formed by the cutouts 304 and conveys it along there which is away from the plane of the reed 302 in a perpendicular direction and, consequently, catching of the weft 312 in the direction of the slot-shaped openings 314 is impossible.

For the purpose of supplying the discharge openings or nozzles 109,209 and 309 and 431 with the fluid required for the insertion of the weft in the shed 108,208 and 308, the loom is equipped with a number of pressurizing means, for example in the form of pumps 401, according to the typical embodiment illustrated in FIGS. 9 to 12, said means being connected with the nozzles through feed pipes with the pressurizing means or pump delivering the fluid to their associated nozzle in synchronism with the picking motion of the weft. These pressurizing means or pumps 401 are mounted in series axially on the shaft driving them and are arranged in the loom with slay 403, fabric take-off 404, cloth beam 405, heddles 406, warp beam 407 in a manner pivotable about a shaft 402 so that the active impulse of each individual pump 401 can be separately timed by adjustment in the area of a clamping slot 408. The drive of the pump 401 from the shaft 402 is effected from the loom shaft 409, for example by means of a toothed belt or a chain 411, 412 in a manner that the sides of the toothed belt or chain 411, 412 passing over two tensioning pulleys 410 which being mutually supported by spring 413 are separately mounted via arms 415, 416 on shaft 409 form an extended rotation path and are adjustable, for example by means of the screw spindle 414 shown in their position whereby the rotation distance of the toothed belt or the chain 411, 412 is shortened or extended in a contrary sense and thereby a timing adjustment of all pumps 401 driven by the shaft 402 is possible during operation of the loom and is an advantage when a change of loom speed or other measures are effected.

The pumps 401 provided preferably in a plurality are mounted axially on the shaft 402 and their cams 416 are staggered in accordance with the flow field travelling with the leading end of the weft across the cloth width. Such an arrangement is shown in FIG. 10 by the example of the layout of a pump 401 with a support 417, diaphragm 418, pressure casing 419, pump lever 420 which is pivotably mounted on support 417 at 21. The support 417 is pivotably adjustable about the shaft 402 in the region of the slot 408, a clamping screw 423 connected to the loom frame permitting the setting selected to be secured. Fitted to the pump lever 420 there is a roller 424 at the radius of the cam 416 which roller is forced against the cam 416 by a spring 425 bearing against the pump lever 420. The loading of the spring 425 can be adjusted in accordance with the amount of fluid pressure required by a screw loading device 426 which is adjustable in the support 417. The screw loading device 426 is formed with a hole to admit a threaded bolt 427 which carries a diaphragm 418 or a piston. Fitted on this threaded bolt 427 are two nuts 428 which, with a damping flexible body 429 interposed, limit the lift of the pump lever 420 with the piston or diaphragm 418. The possibility of reducing the fluid volume delivered for certain types of fabric thus affords another advantage in saving energy. On the pressure casing 419 are provided delivery lines 430 to the nozzles 431 as well as a check valve 432 to which is connected a common pipe 433 through which the fluid drawn in enters.

FIGS. 11 and 12 are schematic layouts of several pumps 401 arranged in order to save space in a manner that, for instance, the casings 419 with diaphragms 418 overlap or that the pumps are variously used with respect to the position of the diaphragms for a loom. Each pump 401 can supply any desired number of nozzles 431 through flexible lines 430 in order to obtain the desired flow field travelling across the cloth width with the leading end of the weft.

It is, of course, to be understood that the present invention is, by no means, limited to the specific showing in the drawings, but also comprises any modifications withint the scope of the appended claims.

What I claim is:

1. Apparatus for inserting a weft through the shed of a loom by means of fluid comprising in combination: a plurality of elements arranged in a row adapted to receive warp threads therebetween, coplanar reeds on the side of said elements opposite the fabric side thereof, recess means formed in said elements and defining weft passage means open on the reed side of said elements, means for rocking said elements and reeds in a circular arc and means for directing a fluid jet generally longitudinally of and in converging relation with said weft passage means in the picking direction to convey a weft along said passage means, at least a portion of said means for directing the fluid jet comprising aperture means formed in a channel of at least some of said elements, at least some of the elements at the downstream end of said jet including a notch to form a continuation of the channel for said jet.

2. Apparatus in combination according to claim 1 in which at least some said elements include openings for said fluid jet, said openings being aligned in the direction of said jet.

3. Apparatus for inserting a weft through the shed of a loom by means of fluid comprising in combination: a plurality of elements arranged in a row adapted to receive warp threads therebetween, coplanar reeds on the side of elements opposite the fabric side thereof, recess means formed in said elements and defining weft passage means formed in said elements and defining weft passage means open on the reed side of said elements, means for rocking said elements and reeds in a circular arc and means for directing a fluid jet generally longitudinally of and in converging relation with said weft passage means in the picking direction to convey a weft along said passage means, at least a portion of said means for directing the fluid jet comprising aperture means formed in a channel of at least some of said elements, at least some said elements including openings for said fluid jet, said openings being aligned in the direction of said jet, at least some of the elements at the downstream end of said jet including a notch to form a continuation of the channel for said jet.

4. Apparatus in combination according to claim 3 in which a plurality of fluid jets are distributed along said weft passage means and all thereof act to urge weft along said passage means in the picking direction.

5. Apparatus in combination 4 according to claim 4 in which an end of one jet overlaps an adjoining end of the next succeeding jet.

6. Apparatus in combination according to claim 3 in which said weft passage means tapers inwardly in a direction away from the plane of said reeds.

7. Apparatus in combination according to claim 3 in which the elements between of said elements having openings each having the said recess therein progressively decrease in size in the picking direction.

8. Apparatus in combination according to claim 3 in which said elements vary in thickness in the direction of the warp threads.

9. Apparatus in combination according to claim 3 in which each recess has a greater dimension in the direction perpendicular to the plane of said reeds than in the direction parallel to said plane.

10. Apparatus in combination according to claim 3 in which each recess has a dimension in the direction perpendicular to the plane of said reeds which is equal to the dimension thereof in the direction parallel to said plane.

11. Apparatus in combination according to claim 3 in which the open sides of the recesses in said elements are aligned for the movement of weft threads therefrom, each of said elements having fluid passage means thereon for said jet.

12. Apparatus in combination according to claim 3 in which said jet approaches said weft passage means at an acute angle.

13. Apparatus in combination according to claim 3 in which said means for directing the fluid jet comprises at least one source of fluid under pressure and operated by said loom in synchronization with movement of said elements and reeds.

14. Apparatus in combination according to claim 13 which includes a plurality of jets and a fluid source for each jet and means for actuating said sources sequentially during operation of said loom.

15. Apparatus in combination according to claim 14 in which each fluid source is operated by a respective cam having a quick return and staggered relative to the other cams with which it is driven in unison by the loom.

16. Apparatus in combination according to claim 15 which includes a shaft on which the cams are mounted, a positive drive from the loom to the shaft, and means for adjusting said shaft.

17. Apparatus in combination according to claim 15 in which each fluid source is spring loaded in discharge direction and is cam actuated in return direction.

18. Apparatus in combination according to claim 17 which includes means for adjusting the spring load on each fluid source.

19. Apparatus in combination according to claim 17 which includes means for limiting the discharge stroke of each fluid source.

20. Apparatus in combination according to claim 18 in which said fluid sources are located near the back axis of said elements and reeds.

21. Apparatus in combination according to claim 20 in which said fluid sources are arranged in staggered relation across the loom.

22. Apparatus in combination according to claim 17 in which each fluid source is movably supported independently of the others thereof.

23. Apparatus in combination according to claim 17 in which each fluid source is in the form of a diaphragm pump.

* * * * *